United States Patent [19]

Upton

[11] 4,392,190

[45] Jul. 5, 1983

[54] SHADED LAMP FOR READING AND LIKE PURPOSES

[76] Inventor: Garthop Upton, 1218 Montego, Arroyo Grande, Calif. 93420

[21] Appl. No.: 222,951

[22] Filed: Jan. 6, 1981

[51] Int. Cl.[3] ..... F21V 17/02

[52] U.S. Cl. ..... 362/281; 362/323; 362/325; 362/354; 362/360; 362/361; 362/367

[58] Field of Search ..... 362/281, 323, 325, 354, 362/360, 361, 367

[56] References Cited

U.S. PATENT DOCUMENTS

| | | | |
|---|---|---|---|
| 1,893,409 | 1/1933 | Grant | 362/323 |
| 1,999,006 | 1/1935 | Grant | 362/323 |

*Primary Examiner*—Stephen J. Lechert, Jr.

*Attorney, Agent, or Firm*—John H. Crowe; Fred N. Schwend

[57] ABSTRACT

Two nested downwardly diverging frustoconical lamp shades are supported at their upper ends by a base which also supports a lamp bulb. The shades have openings therein which, when aligned by adjustment of one of the shades, passes a beam of light from the bulb to a reading or like area. The intensity of illumination can be controlled by changing the extent of overlapping of the openings. Shade elements extend across the lower ends of the shades and have openings therein. One of the shade elements is adjustable relative to the other to move the openings therein in and out of register with the openings in the other element whereby to vary the intensity of illumination of light projected downwardly by the lamp bulb.

8 Claims, 7 Drawing Figures

SHADED LAMP FOR READING AND LIKE PURPOSES

BACKGROUND OF THE INVENTION

1. Field of the Invention

This invention relates to shaded lamps and has particular reference to a shaded lamp in which the area illuminated and the intensity of illumination emanating from the light source may be varied.

2. Description of the Prior Art

In reading, studying, or working at close quarters, it is generally desirable to have an optimum amount of illumination since either over-illumination or under-illumination may give rise to eye discomfort or even eye strain. Also, some persons find it more desirable to illuminate only the area with which they are directly concerned, such as a book or other reading matter, leaving the rest of the surroundings in subdued light or even darkness. Herefore, reading lamps or the like were generally constructed with a lamp shade surrounding the lamp bulb and supported by a swivel mount whereby the lamp may be adjusted to direct light from the bulb generally in a desired direction and usually over a broad area. The amount of illumination was usually fixed or was controlled by an adjustable voltage regulating device, such as a rheostat.

It therefore becomes a principal object of the present invention to provide a reading or like lamp in which the amount of illumination emanating from the light bulb may be adjusted without varying the lamp voltage.

Another object is to provide a reading or the like lamp which may be selectively arranged to illuminate either a broad general area or a specific smaller area or both.

Another object is to provide a reading or the like lamp which may be either placed on a supporting surface to project a beam of light in a generally horizontal direction for reading or like purpose or may be supported above a reading or work surface for projecting a beam of light downwardly onto such surface.

Another object is to provide a reading or like lamp which is simple and economical to manufacture and which is more versatile in use than other reading lamps.

SUMMARY OF THE INVENTION

According to the invention, a reading or like lamp is provided comprising a base for supporting a light bulb therebelow. The base also supports a frustoconical shade which surrounds the bulb. The shade diverges downwardly and has an opening in the side thereof to transmit light from the bulb. A second frustoconical shade rests freely on the first and has a second opening which, when in registery with the first opening, permits the passage of a beam of light from the bulb. By rotatably adjusting the second shade, the opening through the combined shades may be varied in size to vary the intensity of illumination or to completely block off illumination. Also, by this means, the general area being illuminated can be varied in size.

A pair of shade elements extending in a flat plane are mounted on the lower end of the one of the shades. Such elements have openings therein which, when in registry, enable a maximum amount of light to pass downwardly from the bulb as in a conventional shaded lamp. However, by rotatably adjusting one of such shade elements, the intensity of the light passing downwardly from the bulb may be varied as desired or may be completely cut off.

BRIEF DESCRIPTION OF THE DRAWING

The manner in which the above or other objects of the invention are accomplished will be readily understood on reference to the following specification when read in conjunction with the accompanying drawing, wherein.

DESCRIPTION OF THE PREFERRED EMBODIMENT

Figure 1:
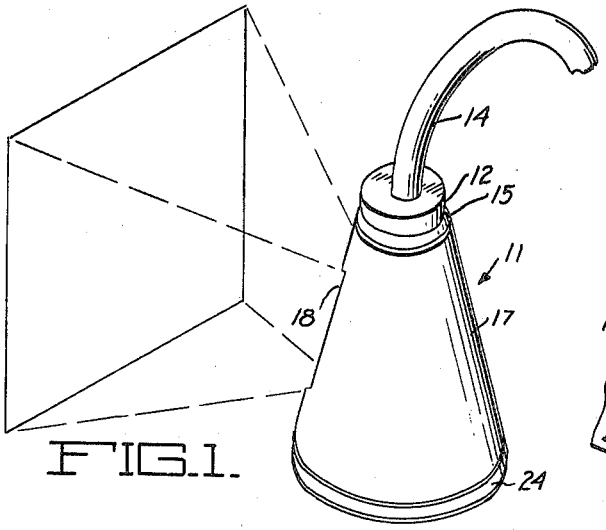
FIG. 1 is a perspective view of a lamp embodying a preferred form of the present invention.

Although this invention is susceptible of embodiment in many different forms, there is shown in the drawing and will be described one specific embodiment, and a modification thereof, with the understanding that the present disclosure is to be considered as an exemplification of the principles of the invention and is not intended to limit the invention to the embodiments shown. The scope of the invention will be pointed out in the appended claims.

Referring to the drawing, the lamp is generally indicated at 11 and comprises a cylindrical base 12 of insulating material and having a socket (not shown) therein for supporting an incandescent light bulb 13 below the base and for supplying electric current to the bulb.

The base 12 may be supported by a conduit 14 carrying suitable electrical conductors for supplying current to the bulb 13. The conduit may be rigid for mounting the lamp 11 in a fixed position or it may be flexible so that the lamp may be oriented in different positions.

A frustoconical shade 15 of thin, preferably opaque material such as plastic, metal, paper, or the like is rotatably mounted on a frustoconical ring 16 secured by a suitable adhesive or the like to the upper end of the base 12, thus permitting rotational adjustment of the shade. The shade 15 extends concentrically of the bulb 13 and diverges downwardly to surround the same.

A second, somewhat shorter frustoconical shade 17, also of thin, preferably opaque material such as plastic, metal, paper, or the like is nested over the shade 15 to fit thereagainst by the action of gravity but is free to be rotatably adjusted relative thereto.

Figure 6:
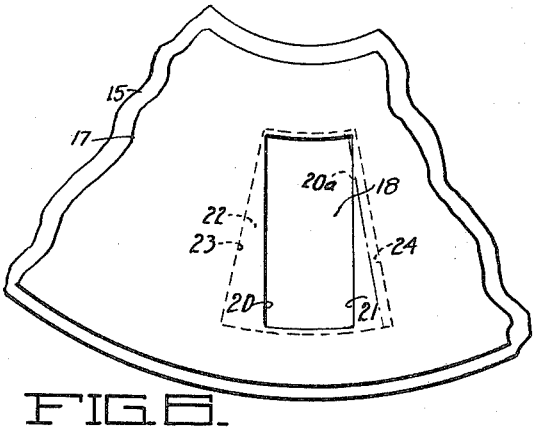
FIG. 6 is a developed view, partly broken away, of the two shades, showing one form of opening in each thereof.

Shade 17 has a rectangular opening 18 formed therein having parallel side edges 20 and 21 which may be arranged to register with an opening 22 formed in shade 15. As seen in FIG. 6, the opening 22 is shaped as a trapezoid, defined by downwardly diverging side edges 23 and 24.

The edges 23 and 24 of opening 22 are so inclined that as the shade 17 is rotatably adjusted clockwise relative to the shade 15, the edge 20 of opening 18 approaches the edge 24 of opening 18 to assume, for example, its position shown by the dot-dash line 20a to form a narrow slit which will substantially reduce the intensity of illumination and also the area covered by the transmitted light beam. Further clockwise rotation of the shade 17 will completely cut off light from passing through the combined openings 18 and 22.

Likewise, when the shade 17 is rotatably adjusted counter-clockwise relative to the shade 15, the opposite edge 21 of opening 18 will approach the edge 23 of opening 22 to form a narrow parallel slit.

Obviously, the edges 23 and 24 could be formed of different angles of divergence so they could form wedge shaped openings in cooperation with the corresponding edges 20 and 21 of opening 18.

Figure 5:
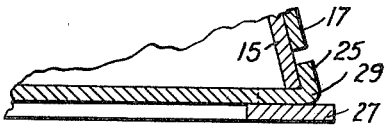
FIG. 5 is an enlarged fragmentary sectional view showing the attachment of one of the shade elements to the inner shade.

A circular shade element 29 located in a flat plane is extended across the lower end of the inner shade 15 and has an upturned flange 25 (FIG. 5) which is suitably secured as by an adhesive to the shade 15. The shade element 29 has a series of three equispaced triangular openings 26 therein which diverge outwardly from the axes of the shades 15 and 17.

A second circular shade element 27 of slightly larger diameter than element 29 is mounted on the latter by a pivot pin 28 for rotational adjustment. The shade element 27 also has three equispaced triangular openings 30 which diverge outwardly from the pivot pin 28.

Figure 3:
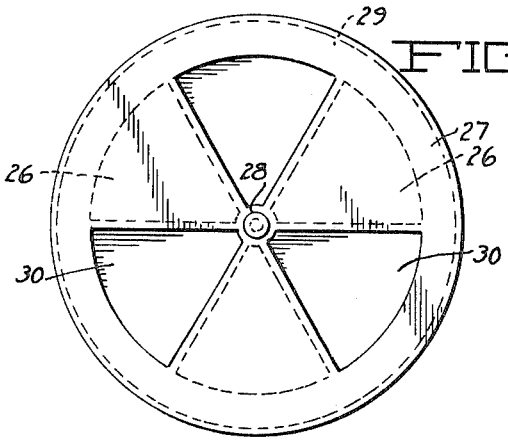
FIG. 3 is a bottom plan view of the lamp.
Figure 4:
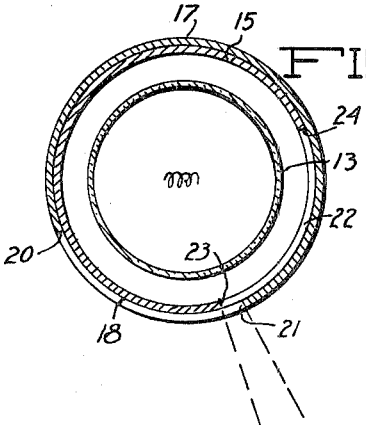
FIG. 4 is a sectional plan view taken along line 4—4 of FIG. 2.

When the shade element 27 is in its position shown in FIG. 3, it will completely cut off all light from passing downwardly from the bulb 13 but when it is rotatably adjusted in either direction, the openings 30 will move into registry with the openings 26 to permit light to pass downwardly from the bulb 13. When the openings 26 and 30 are in full registry with each other, a maximum amount of light is passed to illuminate the area below the lamp.

From the foregoing it will be seen that the lamp 11 may be used as a conventional shaded reading lamp by rotating the outer shade 17 to close off the openings 18 and 22 and by rotating the shade element 27 to locate the openings 30 in full registry with the openings 26. If reduced illumination is desired, the shade element 27 may be adjusted to restrict the amount of light transmitted by the openings 26 and 30 as desired.

On the other hand, if it is desired to project a spot of light on a specific area while maintaining the surroundings dimly lit or darkened, as may be desired in certain applications such as in photography, displaying models, or illuminating a page of a book, the shade element 27 may be rotated to close off the openings 26 and 30. The shade 17 is then rotatably adjusted to pass a desired amount of light in a horizontal direction as seen in FIG. 1.

In certain applications, the lamp support conduit 14 may be removed and the lamp may be supported by placing the same on a suitable horizontal supporting surface. In such case, the shade element 27 would preferably be adjusted to close the openings 26 and 30 to block heat from the lamp from being transmitted to the supporting surface while the shade 17 would be adjusted to register the openings 18 and 22 a desired amount. In this case, the openings 18 and 22 would also act as a vent for any heat generated by bulb 13.

DESCRIPTION OF THE MODIFIED EMBODIMENT

Figure 7:
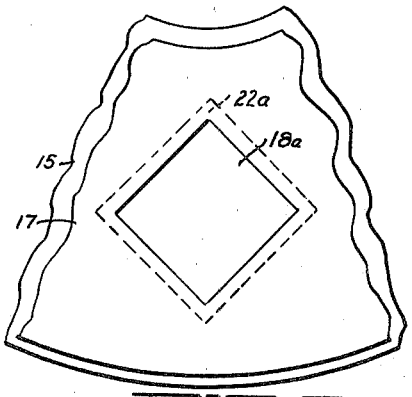
FIG. 7 is a developed view similar to that of FIG. 6 but illustrating another form of shade opening.
Figure 2:
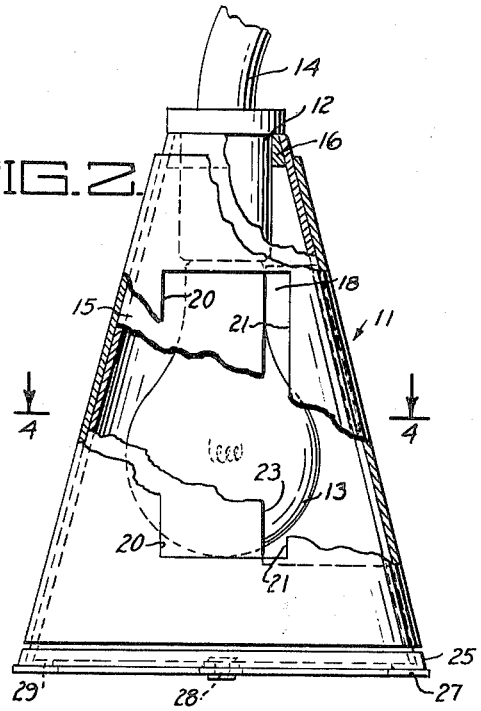
FIG. 2 is a side view of the lamp, shown partly in section.

FIG. 7 illustrates a modified form of the invention in which diamond shaped openings 18a and 22a are formed in the shades 15 and 17 in lieu of the openings shown in FIG. 6. It will be obvious that openings of other shapes such as circular, oval, triangular, etc., could be used as well.

I claim:

1. A lamp for reading or similar purpose comprising:
a base for supporting a light source therebelow;
a first shade having a shape to surround said light source;
means on said base for supporting said first shade at the upper end thereof;
said first shade having a first opening therein for permitting passage of light therethrough from said light source;
a second shade having a shape to surround said first shade;
said second shade having a second opening for permitting passage of said light therethrough from said first opening;
said second shade adapted for rotational adjustment about said first shade whereby to cause said opening to vary the amount of light passing therethrough;
a first shade element extending across the lower end of one of the above-mentioned shades;
said first shade element having a third opening therein;
a second shade element extending over said first shade element;
said second shade element having a fourth opening therein for passing light therethrough from said third opening; and
means supporting said second shade element for movement relative to said first shade element whereby to cause said third and fourth openings to vary the amount of light passing therethrough.

2. A lamp as defined in claim 1 wherein said means on said base for supporting said first shade at the upper end thereof comprises means permitting manual rotatable adjustment of said first shade about its axis.

3. A lamp as defined in claim 1 wherein said first and second shades are frustoconical and diverge outwardly toward their lower ends.

4. A lamp as defined in claim 3 wherein said second shade freely rests on said first shade and is rotatably adjustable about said first shade.

5. A lamp as defined in claim 1 comprising means for pivotally supporting said second shade element for rotation about the axis of said first shade element.

6. A lamp as defined in claim 5 wherein said first and second shades are frustoconical and diverge outwardly toward their lower ends, and wherein said third and fourth openings diverge outwardly from the axis of said first and second shades.

7. A lamp for reading or similar purpose comprising
a base for supporting a light source therebelow,
a first downwardly diverging frustoconical shade for surrounding said light source,
means on said base for supporting said shade at the upper end thereof,
said shade having an opening therein for permitting passage of light from said light source,
a second frustoconical shade nesting on said first shade,
said second shade having a second opening therein for permitting passage of light from said first opening,
said second shade being rotatably adjustable about said first shade whereby to move said second opening relative to said first opening to vary the amount of light passing therethrough.

8. A lamp as defined in claim 7 wherein one of said openings comprises parallel side edges and the other of said openings comprises downwardly diverging side edges.

* * * * *